US006510632B1

(12) United States Patent
Weinacht et al.

(10) Patent No.: US 6,510,632 B1
(45) Date of Patent: Jan. 28, 2003

(54) SMALL DOT DISPLAY ELEMENT

(75) Inventors: Sandor Weinacht, Toronto (CA); Veso S. Trianic, Toronto (CA)

(73) Assignee: Mark IV Industries Limited, Mississauga (CA)

( * ) Notice: Subject to any disclaimer, the term of this patent is extended or adjusted under 35 U.S.C. 154(b) by 154 days.

(21) Appl. No.: 09/654,569

(22) Filed: Sep. 1, 2000

(51) Int. Cl.[7] ..... G09F 9/00

(52) U.S. Cl. ..... 40/449; 340/815.62; 345/111

(58) Field of Search ..... 40/449; 340/815.47, 340/815.55, 815.58, 815.62; 345/108–111, 903; 336/145, 170, 180

(56) References Cited

U.S. PATENT DOCUMENTS

| | | | | |
|---|---|---|---|---|
| 3,365,824 A | * | 1/1968 | Winrow | 40/449 |
| 3,469,258 A | * | 9/1969 | Winrow | 40/449 X |
| 4,577,427 A | | 3/1986 | Browne | |
| 4,775,862 A | | 10/1988 | Kent | |
| 4,779,082 A | * | 10/1988 | Salam | 40/449 X |
| 5,005,305 A | * | 4/1991 | Turney et al. | 40/449 |
| 5,055,832 A | * | 10/1991 | Browne | 40/449 X |
| 5,148,156 A | | 9/1992 | Huber et al. | 40/449 X |
| 5,642,130 A | | 6/1997 | Browne | |
| 5,771,616 A | | 6/1998 | Tijanic | 40/452 |
| 5,793,343 A | | 8/1998 | Hart et al. | 40/447 X |
| 5,809,675 A | | 9/1998 | Tijanic et al. | 40/449 |
| 5,898,418 A | * | 4/1999 | Kao | 345/108 |
| 5,999,079 A | | 12/1999 | Wille | |
| 6,005,465 A | | 12/1999 | Kronenberg et al. | |

FOREIGN PATENT DOCUMENTS

DE 195 45 255 A1 5/1997

* cited by examiner

*Primary Examiner*—Joanne Silbermann
(74) *Attorney, Agent, or Firm*—Dowell & Dowell, P.C.

(57) ABSTRACT

A small dot or disk flip dot display element and a method of making a flip dot display formed of such elements is shown where the disks or dots flip between an ON position showing a bright surface and an OFF position showing a dark surface. The dots are flipped by electromagnets having poles with a first coil wound thereon for producing a reversible magnetic field operating the flip dots. A second coil is wound on the poles in series with the first coil. The second coil is dipped in molten solder to form an electrical contact for energizing the first coils, and for mounting the elements to a circuit board. Separate terminal pins are not required for electrical connections to the coils, thus allowing flip dots as small as 5 mm or less to be used.

13 Claims, 3 Drawing Sheets

SMALL DOT DISPLAY ELEMENT

FIELD OF THE INVENTION

This invention relates to display signs wherein an array of electromagnetically actuated disks selectively flip between a bright side of the disk being in view and an opposite dark side of the disk being in view.

BACKGROUND OF THE ART

In the past, electronic flip disk or flip dot signs have been produced having an array of these disks mounted in a housing. The disks are magnetic and electromagnets are used to flip or rotate the disks, so that alternate bright or ON sides are in view or opposite dark or OFF sides are in view. Preselected disks are chosen to have their bright or ON sides displayed in a particular pattern, such as alphanumeric characters or a graphic image.

In the prior art displays, the electromagnetic actuating devices are usually in the form of poles with coils wound thereon. The wires that form the windings of these coils need to be connected to a power source, and this usually done by providing terminal posts or connector pins to which the ends of the wires are electrically connected. An example of this is shown in U.S. Pat. No. 4,577,427 issued to John Browne.

A difficulty with these prior art flip disk displays, however, is that the size of the flip disks cannot be made small enough. The size of the flip disks is related to the spacing between the electromagnetic coils that actuate the disks and the connector pins that electrically connect the wires of the coils. In the manufacturing process for making these devices, the poles of the electromagnets and the connector pins are first mounted in a base or housing member on which the flip disks are mounted. The coils are then wound on the poles and the connector pins by automated winding machines. There is a limit as to how close together the poles and connector pins can be placed, or the winding machines cannot get in to wind the coils. As a result, flip disk signs in the past have been limited to where the disks have a width or diameter that cannot be made much less than about 0.9 centimeters. For a high resolution display sign, the disks need to be much smaller than that and spaced much more closely together.

SUMMARY OF THE INVENTION

The present invention provides a means and method for eliminating the connector pins in an electromagnetic display sign, so that the electromagnet poles can be spaced very close together and consequently the flip disks can be made very small, yet the coils on the electromagnet poles can still be wound using conventional coil winding apparatus.

According to one aspect of the invention, there is provided a flip dot display element comprising a housing and a disk-like member pivotally mounted in the housing to rotate about a pivot axis between an ON position showing a bright surface on one side of the disk-like member and an OFF position showing a dark surface on the opposite side thereof. The disk-like member includes a magnet having a magnetic axis transverse to the pivot axis. A pair of opposed spaced-apart poles are mounted in the housing on either side of the pivot axis and extend below the disk-like member to pole lower distal end portions. The poles include first coils wound thereon in series to produce reversible magnetic fields in the poles of opposite polarity to interact with the disk-like member magnet and flip the disk-like member between the ON and OFF positions. The poles include second coils located on the respective pole lower distal end portions and connected in series with the respective first coils. Also, a conductive coating is formed on the second coils in electrical contact therewith, the conductive coatings forming electrical contacts for energizing the first coils.

According to another aspect of the invention, there is provided a method of making a flip dot display formed of display elements having magnetic disk-like members pivotally mounted in a housing. The method comprises the steps of mounting spaced-apart poles in the housing extending below each disk-like member to flip the disk-like members upon magnetic fields being induced in the poles. First insulated wire coils are wound onto the coils in series to induce reversible magnetic fields of opposite polarity in the poles. Second insulated wire coils are wound on the poles in series respective with the first coils and located below the first coils. The second coils are then dipped into molten solder to remove the wire insulation therefrom and form electrical contacts for energizing the first coils.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
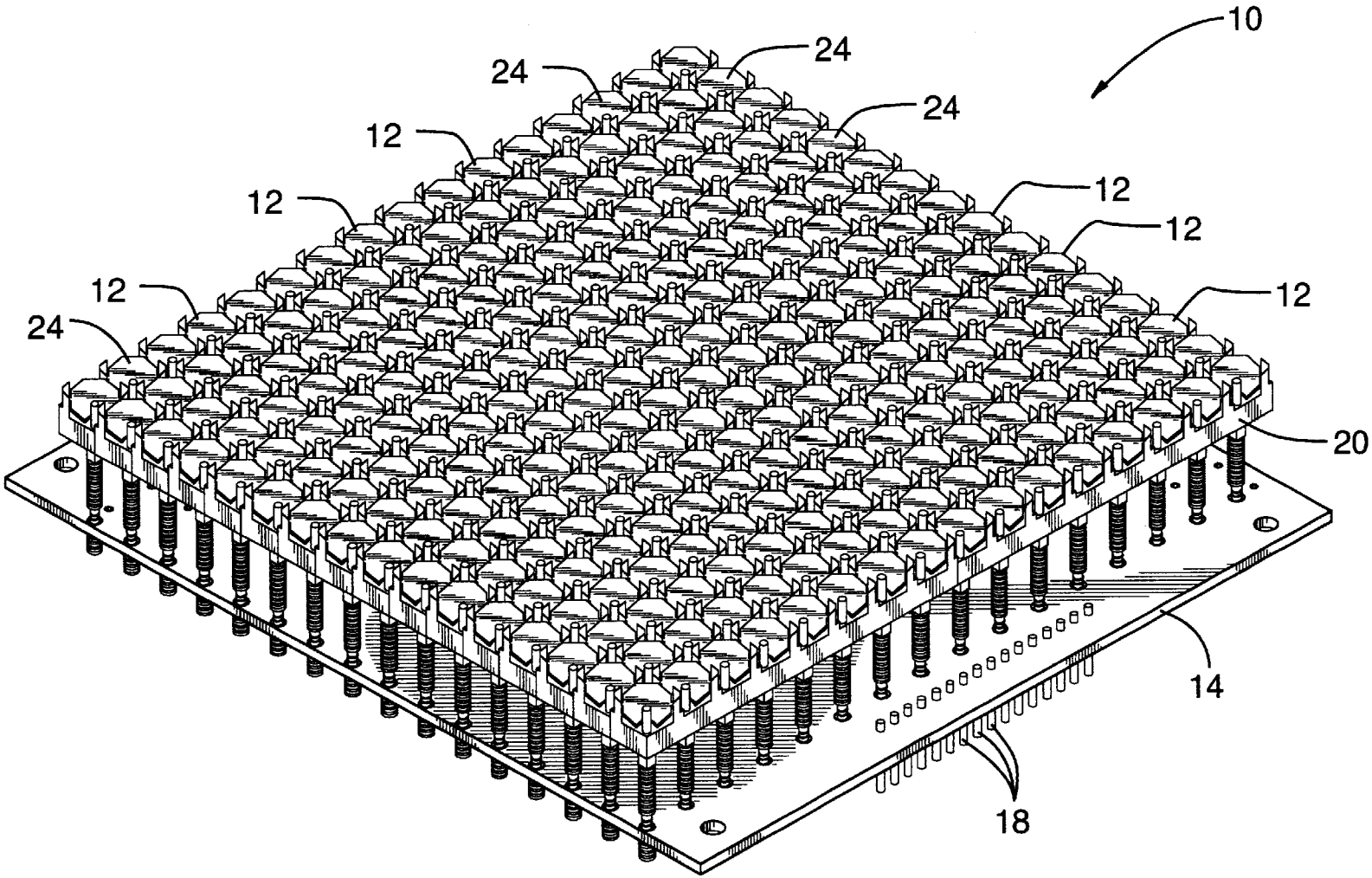
FIG. 1 is a perspective view of an array of preferred embodiment display elements mounted on a circuit board in accordance with the present invention.
Figure 2:
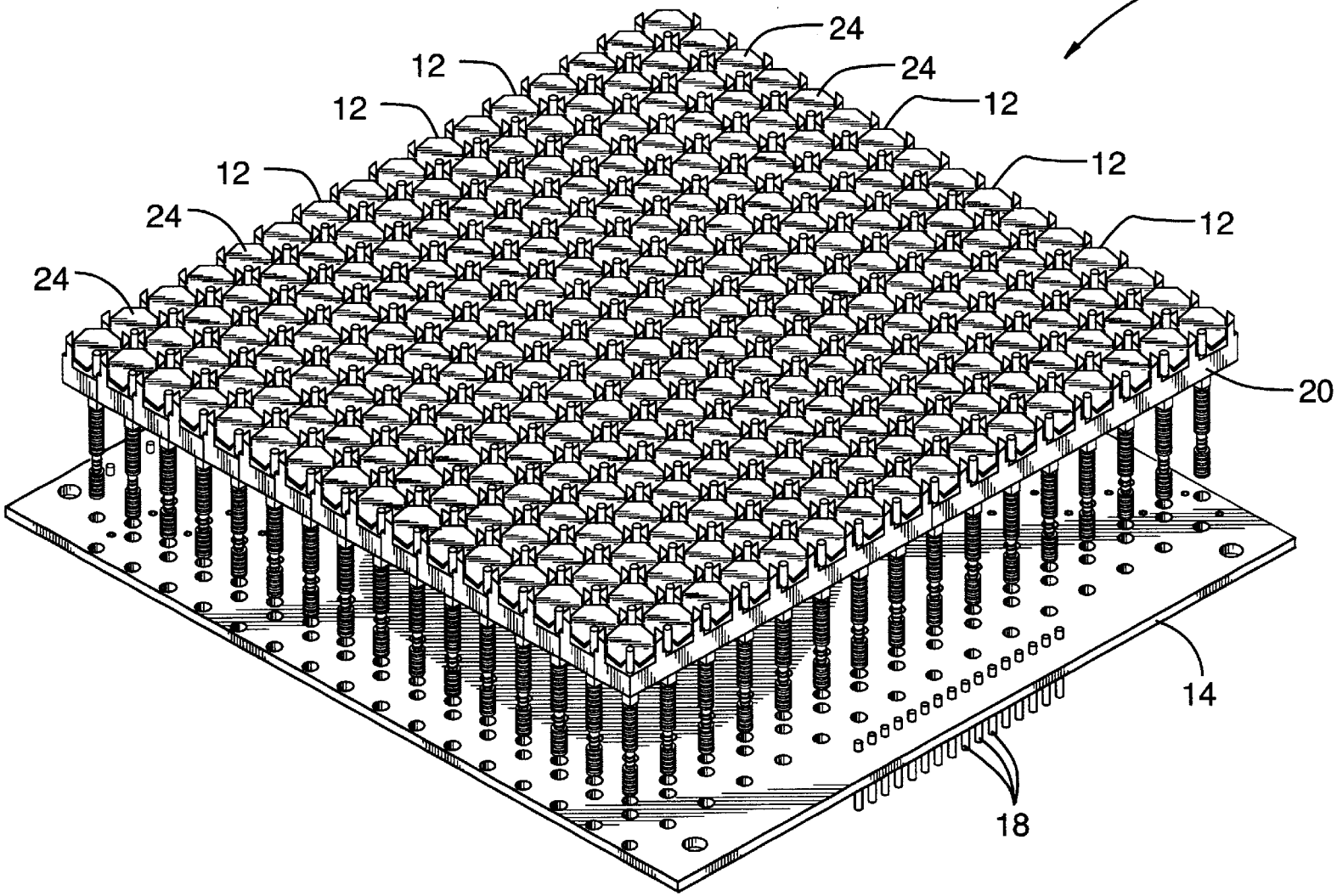
FIG. 2 is a perspective view similar to FIG. 1, but showing the display of array elements prior to being mounted on the circuit board.

Referring to the drawings, a display 10 is shown in FIG. 1 made up of a plurality of display elements 12 mounted on a circuit board 14. Display 10, as shown in FIGS. 1 and 2, is a 16×16 element array containing sixteen rows and sixteen columns of display elements 12. However, this is just a matter of convenience or is dictated by the size circuit board 14. Circuit board 14 is a typical or conventional printed wiring board or printed circuit board and is not considered to be part of the present invention, per se. As will be appreciated by those skilled in the art, circuit board 14 would have an appropriate printed circuit of conductors (not shown) formed thereon. As seen best in FIG. 3, these conductors would lead to holes 16 which are used for mounting and electrically connecting display elements 12, as will be discussed further below. circuit board 14 is also provided with connector pins 18 for connecting circuit board 14 to a suitable controller and power source (not shown), again which is conventional for this type of display sign.

Figure 3:
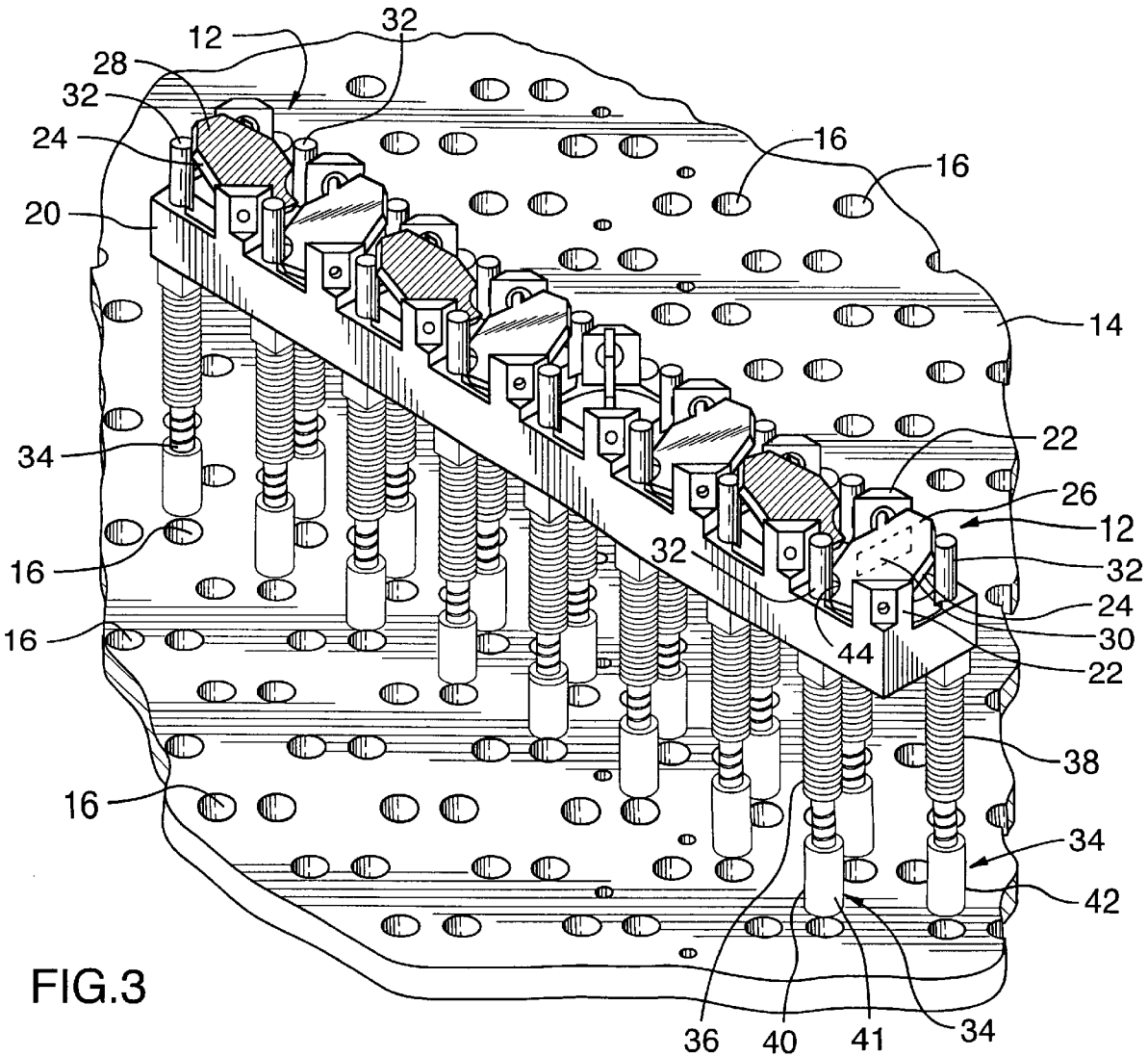
FIG. 3 is an enlarged perspective view of a strip of display elements made according to the preferred embodiment of the invention prior to said strip being mounted on a circuit board.

Referring in particular to FIG. 3, display elements 12 include a housing 20 which, in the embodiment shown in FIG. 3, is a strip containing one row of eight display elements 12. However, the housing 20 may be constructed to contain any number of rows of any number of display elements 12, including a single display element 12, to suit the particular application. A strip of eight display elements 12 in a housing 20 is convenient for handling and assembly purposes.

For each display element 12, the housing 20 includes a pair of opposed, upright comer members 22 for pivotally mounting disk-like flip disks or dots 24 therein. Flip disks 24 pivot or rotate about a pivot axis extending between corner members 22. Flip disks 24 pivot about this axis between an ON position showing a bright surface 26 on one side of the disk-like flip disk member and an OFF position showing a dark surface 28 on the opposite side thereof. It will be appreciated that each disk-like flip disk 24 has an ON bright surface 26 on one side and an OFF dark surface 28 on the reverse or opposite side. Looking at FIG. 3 from the upper left corner to the lower right corner of the strip of display elements 12, the first, third and seventh flip disks 24 are showing their dark or OFF sides in the viewing direction, or looking downwardly. The flip disks 24 in the second, fourth, sixth and eighth position have their bright or ON surfaces 26 facing upwardly or in view. The flip disk 24 in the fifth position is shown on edge to indicate that it is in the process of flipping between the ON and the OFF positions.

The disk-like flip disk members 24 each include a magnet 30 mounted on or embedded therein. Preferably, flip disks 24 are made of a plurality of layers laminated together and magnet 30 is located in one of the central layers. However, the entire flip disk 24 could be made of magnetic material itself and painted or coated to give the coil the opposite bright and dark surfaces, if desired. Magnets 30 have a magnetic axis which is transverse to the pivot axis of flip disks 24.

Each display element 12 has a pair of opposed spaced-apart poles 32 to mounted in housing 20 on either side of the pivot axis of each flip disk 24. The poles 32 extend below the disk-like flip disk members 24 to lower distal end portions 34. First insulated wire coils 36 and 38 are wound on respective poles 32 in series, but in opposite directions to produce reversible magnetic fields in poles 32 of opposite polarity. When coils 36, 38 are energized, they produce a magnetic force to interact with flip disks 24 to flip the disks between the ON and OFF positions. The direction that the disks 24 are flipped or rotated depends upon the polarity of the current supplied to coils 36, 38 and the starting position of the disks.

The poles 32 also include respective second coils 40, 42 located on the pole lower distal end portions 34 and connected in series with the respective first coils 36, 38. Second coils 40, 42 are actually dipped in solder that forms a conductive coating 41 making the second coils 40, 42 electrical contacts which carry current in a straight upward direction, rather than a spiralling upward direction, to energize the first coils 36, 38. Consequently, second coils 40, 42 behave more like solid conductors rather than coils, will be described further below. It will be noted, however, that second coils 40,42 are spaced below first coils 36, 38. This is to prevent the first coils 36, 38, or portions thereof, from coming into contact with the solder when the second coils 40, 42 are dipped in the solder. If dipped in solder, the ability of the first coils 36, 38 to generate the magnetic fields will be compromised or destroyed.

Poles 32 are made of carbon steel with a copper coating thereon to reduce unwanted eddy currents during polarity changes. The poles are further coated to prevent the copper coating from oxidizing. Poles 32 are shown having a circular or round cross section, but they could have a square or rectangular cross section as well.

It will be noted that flip disks 24 in the ON and OFF positions are at an angle to the normal viewing direction thereof. This is to reduce the starting torque required to flip the disks. The opposed poles 32 extend up below the disklike flip disk members 24 and form stops to limit the rotation of the flip disks 24 and hold them in the desired angled position. Flip disks 24 have cut-outs 44 on one side thereof to provide clearance for the pole 32 that is not acting as a stop. This also allows the angle of inclination of flip disks 24 to be reduced. It is preferable to have the angle of inclination as low as possible to improve visibility of the disks from different angles. The angle of inclination is also dependent on the size and number of turns in first coils 36, 38, because the lower the angle of inclination of flip disks 24 is, the stronger is the magnetic field required to flip the disks. It should be appreciated that the angle of inclination of the flip disks may be quite small, such as one or two degrees, or even zero, in situations where sufficient magnetic force can be generated to flip the disks.

Flip disks 24 are shown to be octagonal in plan view, but they could be circular or any other configuration desired.

In the assembly of display 10, housings 20 are provided to accommodate the number of display elements 12 desired. Poles 32 are then mounted in the housing 20. Poles 32 project upwardly a predetermined distance to provide the necessary stops for disks 24 to set the angle of inclination of the disks. Poles 32 also extend below the flip disks 24 and below housing 20, so that the respective first and second coils 36, 40 or 38, 42 can be wound thereon. The coils are wound by starting with one of the second coils 40 or 42. The winder is then advanced to wind the adjacent first coil 36 or 38, but with the first coil spaced from the second coil. The winder then skips over to the adjacent pole of the pair of poles in display element 12 and winds the first and second coils thereon in that order. When the final second coil is wound, the wire is cut or broken off. After all of the coils are wound, the second coils 40, 42 are dipped in solder to remove the wire insulation therefrom and form an electrical contact for energizing the first coils. If desired, poles 32 can be coated with a nonconducting coating prior to winding the coils, so that the soldering of second coils 40, 42 would not cause the second coils to make electrical contact with the poles. After all of the second coils 40, 42 are thus coated with solder, the strip of display elements is then mounted on circuit board 14 by placing the second coils 40, 42 into respective holes 16. Further heat is then applied to solder second coils 40, 42 in place and complete the mounting of display elements 12 on circuit board 14. Flip disks 24 can be mounted in housing 20 either before or after the display elements are mounted on circuit board 14. Flip disks 24 are made of resilient, flexible material so they snap into position in respective holes in corner members 22.

If desired, instead of using holes 16 in circuit board 14 for the mounting of display elements 12, the display elements could be surface mounted on a circuit board. The second coils 40, 42 would then act like pads and a conventional reflow soldering technique would be used for mounting display elements 12. Second coils 40, 42 have just enough wire turns on them to provide sufficient contact area for mounting the display elements 12 on circuit board 14. Rather than using solder as the conductive coating for second coils 40, 42, some other type of conductive coating could be used to provide the necessary electrical contact on circuit board 14.

With this invention, flip disks 24 can be made with an effective width or diameter of 5 mm or less. Of course, larger size disks are possible as well. Preferably, poles 32 are spaced apart just enough to wind the first and second coils thereon, and this allows for the smallest size flip disks 24 to be used.

Having described preferred embodiments of the invention, it will be appreciated that various modifications may be made to the structures described above. For example, poles 32 could be some other configuration or shape and just straight rods. They could also be located on an angle, or at least the upper portions of the poles angled to optimize the direction of the magnetic lines of force and perhaps eliminate the need for notches 44.

As will be apparent to those skilled in the art in the light of the foregoing disclosure, many alterations and modifications are possible in the practice of this invention without departing from the spirit or scope thereof. The foregoing description of the preferred embodiments is by way of example only, and is not to limit the scope of the invention.

What is claimed is:

1. A flip dot display element comprising:

a housing;

a disk-like member pivotally mounted in the housing to rotate about a pivot axis between an ON position showing a bright surface on one side of the disk-like member and an OFF position showing a dark surface on the opposite side thereof, the disk-like member including a magnet having a magnetic axis transverse to the pivot axis;

a pair of opposed spaced-apart poles mounted in the housing on either side of the pivot axis and extending below the disk-like member to pole lower distal end portions, the poles including first coils wound thereon in series to produce reversible magnetic fields in the poles of opposite polarity to interact with the disk-like member magnet and flip the disk-like member between the ON and OFF positions;

the poles including second coils located on the respective pole lower distal end portions and connected in series with the respective first coils; and a conductive coating formed on the second coils in electrical contact therewith, the conductive coatings forming electrical contacts for energizing the first coils.

2. A display element as claimed in claim 1 wherein the first and second coils are spaced apart on each pole.

3. A display element as claimed in claim 2 and further comprising a printed wiring board, the second coils being soldered to the printed wiring board to mount the display element thereon.

4. A display element as claimed in claim 3 wherein the second coils have just enough turns to provide sufficient contact area for mounting the display element.

5. A display element as claimed in claim 3 wherein the printed wiring board contains holes to accommodate the second coils.

6. A display element as claimed in claim 3 wherein the disk-like member is a first disk-like member, and further comprising a plurality of like disk-like members pivotally mounted in the housing to form an array, and wherein said poles and coils thereon are a first pair of poles and coils, and further comprising a plurality of like pairs of spaced-apart poles and coils mounted respectively to extend below each disk-like member, all of the second coils being soldered to the printed wiring board.

7. A display element as claimed in claim 1 and further comprising a printed wiring board having holes therein and conductors leading to said holes, and wherein the second coils are mounted in the holes with the conductive coatings thereon in electrical contact with the conductors.

8. A display element as claimed in claim 1 wherein the conductive coating is solder.

9. A display element as claimed in claim 1 wherein the disk-like member has an effective diameter of 5 mm or less.

10. A display element as claimed in claim 9 wherein the disk-like member ON and OFF positions are at an angle to the normal viewing direction thereof, the opposed poles extending up below the disk-like member to form stops to limit the rotation of the disk-like member.

11. A display element as claimed in claim 10 wherein the disk-like member has one side defining a cut-out for clearance of a pole not acting as a stop.

12. A display element as claimed in claim 1 wherein the poles have a cross-section that is one of round and square.

13. A display element as claimed in claim 12 wherein the poles are coated with a nonconductive coating.

* * * * *

UNITED STATES PATENT AND TRADEMARK OFFICE

CERTIFICATE OF CORRECTION

PATENT NO. : 6,510,632 B1
DATED : January 28, 2003
INVENTOR(S) : Weinacht et al.

It is certified that error appears in the above-identified patent and that said Letters Patent is hereby corrected as shown below:

Title page,
Item [75], Inventors, should read -- Veso S. Tijanic --

Signed and Sealed this

Twentieth Day of January, 2004

JON W. DUDAS
*Acting Director of the United States Patent and Trademark Office*